US005988994A

United States Patent [19]

Berchowitz

[11] Patent Number: 5,988,994

[45] Date of Patent: Nov. 23, 1999

[54] ANGULARLY OSCILLATING, VARIABLE DISPLACEMENT COMPRESSOR

[75] Inventor: David M. Berchowitz, Athens, Ohio

[73] Assignee: Global Cooling Manufacturing Company, Athens, Ohio

[21] Appl. No.: 08/955,081

[22] Filed: Oct. 21, 1997

[51] Int. Cl.[6] ..... F04B 35/04

[52] U.S. Cl. ..... 417/415; 417/319

[58] Field of Search ..... 417/415, 319; 123/18 R, 19

[56] References Cited

U.S. PATENT DOCUMENTS

| | | | |
|---|---|---|---|
| 20,842 | 7/1858 | Darker, Jr. . | |
| 1,189,834 | 7/1916 | Kress . | |
| 1,275,616 | 8/1918 | Short | 123/18 R |
| 1,442,319 | 1/1923 | Wilson . | |
| 1,468,516 | 9/1923 | Schiller . | |
| 1,705,826 | 3/1929 | Polizzi . | |
| 1,744,542 | 1/1930 | Gough . | |
| 2,928,375 | 3/1960 | Herrmann . | |
| 2,956,302 | 10/1960 | Rolph et al. . | |
| 3,190,190 | 6/1965 | Rudd et al. . | |
| 3,195,420 | 7/1965 | Johannsen . | |
| 3,291,006 | 12/1966 | Brundage . | |
| 3,475,629 | 10/1969 | Lagier . | |
| 3,747,421 | 7/1973 | Eschenbach . | |
| 3,820,376 | 6/1974 | Koch et al. . | |
| 3,967,541 | 7/1976 | Born et al. . | |
| 3,977,648 | 8/1976 | Sigmon . | |
| 4,058,088 | 11/1977 | Brown . | |
| 4,099,448 | 7/1978 | Young . | |
| 4,379,543 | 4/1983 | Reaves . | |
| 4,539,941 | 9/1985 | Wang . | |
| 4,543,916 | 10/1985 | Giorno | 123/65 |
| 4,656,376 | 4/1987 | Hyidal | 310/41 |
| 4,683,849 | 8/1987 | Brown | 123/192 B |
| 4,823,743 | 4/1989 | Ansdale . | |
| 4,884,532 | 12/1989 | Tan et al. | 123/18 R |
| 4,947,731 | 8/1990 | Johnston | 91/229 |
| 5,025,756 | 6/1991 | Nye . | |
| 5,152,254 | 10/1992 | Sakita . | |
| 5,156,005 | 10/1992 | Redlich . | |
| 5,215,447 | 6/1993 | Wen | 417/319 |
| 5,228,414 | 7/1993 | Crawford | 123/18 R |
| 5,343,773 | 9/1994 | Lehna . | |
| 5,345,833 | 9/1994 | Sugimoto . | |
| 5,450,521 | 9/1995 | Redlich . | |
| 5,592,073 | 1/1997 | Redlich . | |

FOREIGN PATENT DOCUMENTS

| | | |
|---|---|---|
| 54778 | 12/1889 | Germany . |
| 2145564 | 3/1973 | Germany . |
| 2256776 | 6/1974 | Germany . |
| 577656 | 5/1946 | United Kingdom . |
| WO87/03331 | 6/1987 | WIPO . |

OTHER PUBLICATIONS

1996 Ashrae Handbook, "Heating Ventilating, and Air–Conditioning Systems and Equipment", SI Edition, p. 34.8, by American Society of Heating, Refrigerating and Air–Conditioning Engineers, Inc.

*Primary Examiner*—Charles G. Freay
*Assistant Examiner*—Robert Z. Evora
*Attorney, Agent, or Firm*—Frank H. Foster; Kremblas, Foster, Millard & Pollick

[57] ABSTRACT

A pump or compressor wherein the volumetric displacement of a piston cylinder assembly is variable. The piston is connected to a crank slider or eccentric mechanical drive, the crankshaft of which oscillates alternately clockwise through a controllably variable angle θ and counterclockwise through substantially the same angle θ, the angle θ being measured from the angular position of the crankshaft or eccentric at which separation between piston and the closed end of the bore is a minimum (Top Dead Center). The angle of crank oscillation controls the degree of volumetric displacement of the piston. The crank shaft is connected to a torsional spring so as to substantially resonate the rotational inertia of the moving parts. An oscillating electric motor supplies the oscillating torque to drive the mechanism at constant frequency but controllably variable angular amplitude.

17 Claims, 5 Drawing Sheets

MAXIMUM CCW ROTATION

TOP DEAD CENTER

MAXIMUM CW ROTATION

MULTIPLE CYLINDER ARRANGEMENT
(THREE CYLINDERS IN THIS CASE)

ANGULARLY OSCILLATING, VARIABLE DISPLACEMENT COMPRESSOR

BACKGROUND OF THE INVENTION

1. Field Of The Invention

The present invention relates to an apparatus and method to control the capacity of a reciprocating type pump generally and preferably or most usefully a compressor. By controlling the volumetric capacity of the pump, the mass through-put is controlled. In the case of a Rankine cycle machine, the current invention together with standard suction or discharge control, would provide a direct means to control the heat pumping capacity of the cycle without compromising efficiency.

2. Description Of The Related Art

According to the 1996 ASHRAE Handbook "Systems and Equipment Handbook (SI)", page 34.8, capacity control may be obtained by one or more of the following:

(1) controlling suction pressure by throttling;

(2) controlling discharge pressure;

(3) returning discharge gas to suction;

(4) adding re-expansion volume;

(5) changing the stroke;

(6) opening a cylinder discharge port to suction while closing the port to discharge manifold;

(7) changing compressor speed;

(8) closing off cylinder inlet, and (9) holding the suction valve open.

The ASHRAE handbook states that the most commonly used methods are the opening of the suction valves by some external force, gas bypassing within the compressor, and gas bypassing outside the compressor. Most of these techniques seriously compromise the compressor efficiency. Changing compressor speed does not directly compromise efficiency but does have the practical problem of exciting various structural resonances as the speed changes. Stroke variation is another technique that avoids efficiency penalties provided that the top dead center (TDC) clearance volume is minimized. One means of achieving stroke control is to connect the piston directly to a linear motor plunger. In this case the piston position is free, that is, it is not fixed by the kinematic geometry of the machine. Capacity control is achieved directly since the linear motor plunger amplitude is controllable. This configuration is generally referred to as the "Linear Compressor". The major difficulty with the linear compressor is the control of the approach clearance between the piston and the valve plate at TDC. In order to achieve high efficiencies, the clearance needs to be as small as possible. Even a momentary loss of control could result in the piston colliding with the valve plate resulting in catastrophic damage. Linear compressor design generally compromises efficiency by increasing the TDC clearance so as to minimize collision problems.

An alternative method of capacity control employed by linear compressors is to vary the dead space at TDC. This technique is referred to as adding re-expansion volume. In this case efficiency is directly compromised by introducing severe irreversibilities associated with hysteresis losses.

According to the 1996 ASHRAE Handbook "Systems and Equipment Handbook (SI)", page 34.8, an ideal capacity control system would have the following operating characteristics:

Continuous adjustment to load

Full-load efficiency unaffected by the control

No loss in efficiency at part load

Reduction of starting torque

No reduction in compressor reliability

No reduction in compressor operating range

No increase in compressor vibration and sound level at part load

The object of the present invention is to meet all of the ideal characteristics in a simple direct manner.

SUMMARY OF THE INVENTION

This invention implements capacity control in a reciprocating compressor by stroke variation while simultaneously maintaining constant TDC clearance at all strokes. An additional advantage is that frequency of operation is constant so as to avoid resonance induced noise problems, such as encountered with variable speed controls.

A reciprocating type pump is disclosed in which a piston crank slider (piston connecting rod crankshaft) assembly, or similar drive is driven by an electric motor in a resonant oscillatory fashion. The crankshaft rotates alternately clockwise through a controllably variable angle $\theta$ and counterclockwise through substantially the same angle $\theta$, the angle $\theta$ being measured from the angular position of the crankshaft or eccentric at which separation between piston and the closed end of the bore is a minimum (Top Dead Center). The maximum value of angle $\theta$ will be somewhat smaller than 180°, and for efficient electric motor drive less than 90°. As the crankshaft moves it stores elastic energy in a torsional spring. In most cases it will be desirable to substantially resonate the rotating inertia of the moving parts by the torsional spring. By doing this, the torque required by the electric motor will be minimized and additionally, a centering force will be provided. The torsional spring may be any element capable of storing sufficient elastic energy. For example, gas springs, a torque rod or a spirally wound mechanical spring or any combination of springs. The torsional spring will alternately store and deliver the rotational kinetic energy of the moving parts. At resonance, the amplitude of the oscillation will be approximately directly proportional to the amplitude of the RMS voltage applied to the electric motor. The motor will deliver peak torque roughly proportional to the applied RMS voltage. Variation of the compressor stroke volume will, in the first order, then be directly proportional to applied RMS voltage. Applied RMS voltage is therefore the control input for continuous capacity control. Voltage is easily varied by a number of well established means (eg., Triac circuit as used in light dimmers). The motor for this application must be adapted for oscillatory motion.

One characteristic of this arrangement is that the piston motion frequency will be exactly double the crank motion frequency. Therefore, the crank needs to only move through ±90° for the same volumetric capacity of a regular rotating compressor of identical geometric proportions. Another characteristic of resonant systems is that motion is incipient at the smallest voltages. Therefore there will be no high starting currents.

BRIEF DESCRIPTION OF THE DRAWINGS

The above mentioned features and objects of the present invention will become more apparent by reference to the following description taken in conjunction with the accompanying drawings, in which.

Figures 1, 2, 3:
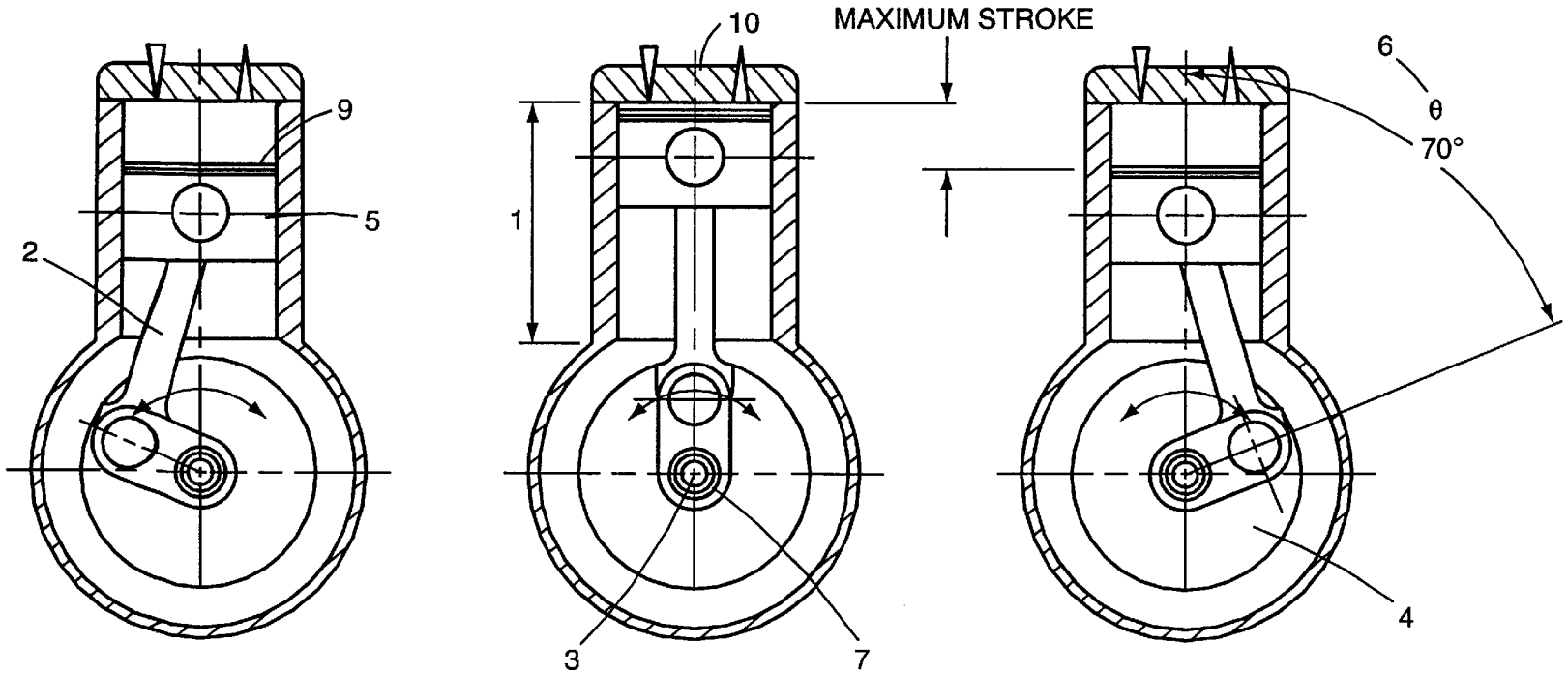
FIG. 1 is a diagrammatic front view of a basic single cylinder embodiment showing the relative positions of the moving parts at the maximum counter clockwise (CCW) rotation limit of the crankshaft. In this case 70° from the zero position. The piston is at bottom dead center (BDC).
FIG. 2 is a diagrammatic front view of a basic single cylinder embodiment showing the relative positions of the moving parts at zero rotational angle of the crankshaft. This is also the position in which the piston reaches top dead center (TDC).
FIG. 3 is a diagrammatic front view of a basic single cylinder embodiment showing the relative positions of the moving parts at the maximum clockwise (CW) rotation limit of the crankshaft. In this case minus 70° from the zero position. The piston is once again at BDC. Clearly, one complete cycle of CW and CCW motion of the crankshaft results in two complete cycles of compression and expansion of the piston. Therefore the piston operates at exactly twice the oscillatory frequency of the shaft.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected or terms similar thereto are often used. They are not limited to direct connection but include connection through other elements where such connection is recognized as being equivalent by those skilled in the art.

DESCRIPTION OF THE PREFERRED EMBODIMENT

Figure 4:
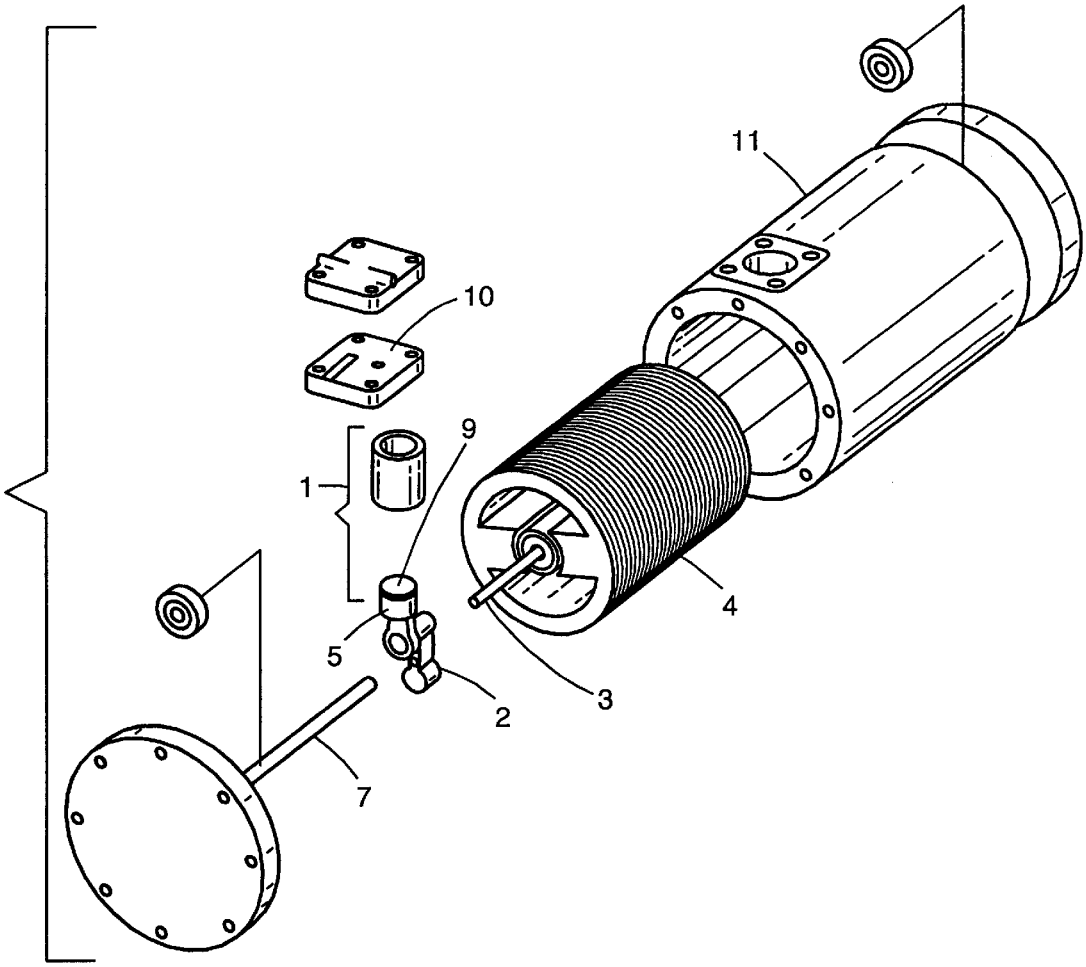
FIG. 4 is an exploded view showing the essential components of the single cylinder embodiment. In particular, a simple rod torsional spring is shown which is coaxial with the axis of the crankshaft.

Referring to FIGS. 1 through 3 there is illustrated a conventional piston cylinder arrangement 1 connected by a crank slider mechanism 2 to a torsional shaft spring 3 capable of storing elastic energy. The crank slider mechanism translates the rotational motion of the crankshaft 7 into linear motion of the piston 5 and, furthermore defines the minimum distance between the piston crown 9 and the valve plate 10. The axis of the torsional shaft spring 3 is in this case also the axis of rotation. An electric motor 4, bolted to the crankcase 11 as shown in FIG. 4, supplies an oscillatory torque which rotates the crank shaft alternately clockwise and counter clockwise. An electric motor which could be used in the present invention is illustrated in U.S. Pat. No. 3,475,629, which is incorporated herein by reference.

At the Top Dead Center position, the elastic energy stored in the torsional spring is zero. During motion elastic energy is stored in the torsional spring. The degree of elastic energy stored is roughly equal to the reduction of kinetic energy of the moving parts. At BDC in the clockwise direction (FIG. 3), the kinetic energy is exhausted and the elastic energy is maximum. At this point the crankshaft begins to move counter clockwise until the piston is again at TDC where the elastic energy stored in the torsional spring is minimum (FIG. 2). Owing to kinetic energy and power from the motor, the crankshaft continues in its counter clockwise direction until it reaches the extreme of its motion in the counter clockwise direction (FIG. 1). At this point the piston is again at BDC. At maximum clockwise and counter clockwise rotation, the elastic energy is maximum. Again referring to FIG. 1, the stroke of the piston 5 is directly related to the amplitude angle of rotation 6. The piston stroke is controlled by controlling the amplitude angle of rotation. The input torque is at constant frequency but with controllably varying peak value. The crank slider mechanism 2, torsional shaft spring 3 and piston 5 all move together in an oscillatory fashion, the piston 5 moving at double the frequency of the input torque.

The spring constant of the torsion spring 3 is preferably chosen to resonate the composite combination of all the masses which are movable and are linked together so that the natural frequency of vibration of the moving parts is substantially the same as the drive frequency of the motor which is the operating frequency of the pump.

Maximum volumetric capacity is dependent on the extent of the motion of the crankshaft 7, and by direct connection, the torsional shaft's 3 motion. Any angle less than the maximum angle 6, the piston 5 will traverse a smaller stroke and the pump will be operating at a proportionally reduced volumetric capacity.

Figure 5:
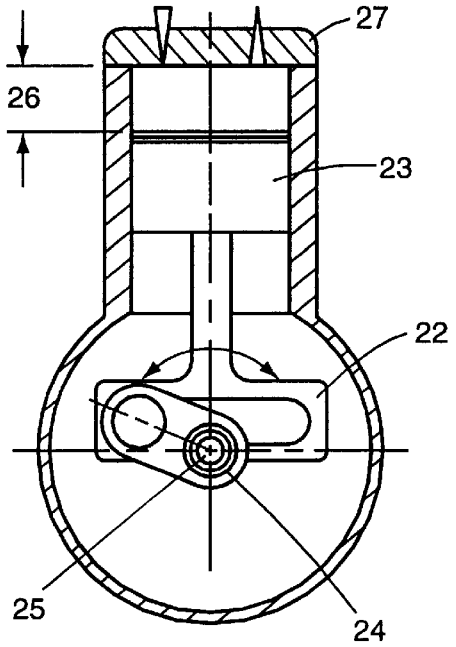
FIG. 5 is a diagrammatic front view of a sketch of a scotch-yoke embodiment as an alternative to the crank-slider arrangement shown in the other figures.

FIG. 5 shows a scotch-yoke mechanism as an alternative to the crank slider mechanism. The scotch-yoke mechanism 22 transfers the oscillatory constant frequency motion of the crank shaft 24 to the piston 23 so that the piston moves with sinusoidally varying displacement. The maximum displacement position 26 is shown in FIG. 5. As in the crank-slider mechanism, the closeness of approach to the valve plate 27 is defined absolutely by the geometry of the mechanism. The scotch-yoke mechanism may have the advantage of smoother operation and less noise owing to greatly reduced higher harmonic content of the motion of the moving parts.

Figure 6:
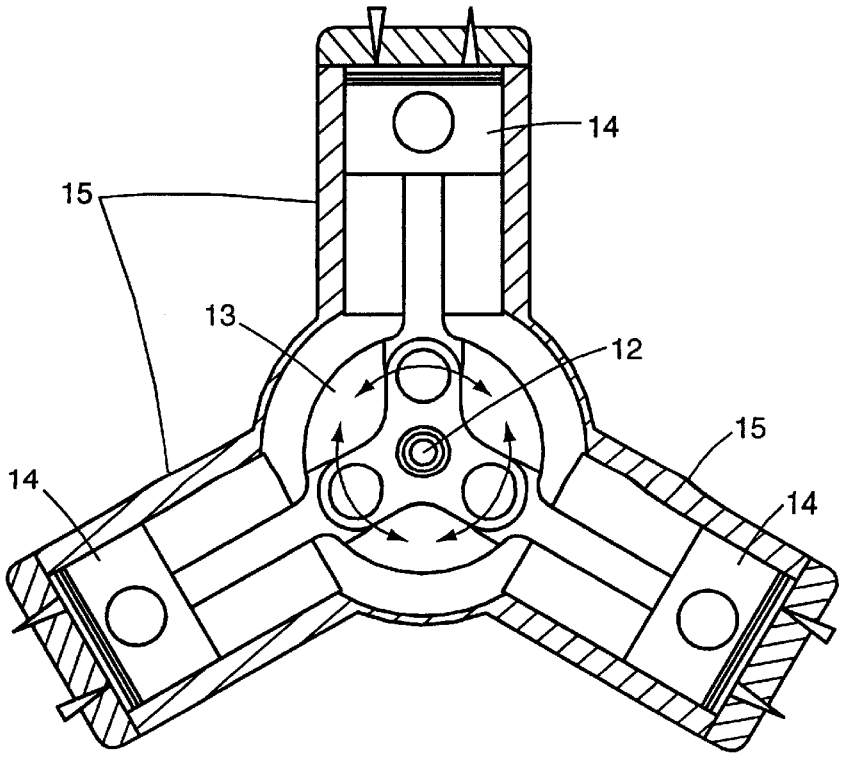
FIG. 6 is a diagrammatic front view of a sketch of a multi-cylinder embodiment. In this case there are three cylinders.

FIG. 6 shows a multiplicity of piston cylinders and crank slider mechanisms (three in this case) connected to a common torsional shaft spring 12 and a common motor 13. Each of the three pistons 14 undergoes the same excursion with respect to its cylinder 15 during crankshaft rotation. For a given system maximum capacity, each piston cylinder arrangement may be of maximum volumetric capacity equal to the system maximum capacity divided by the number of cylinders. This arrangement may have the advantage of lower net vibration.

Figure 7:
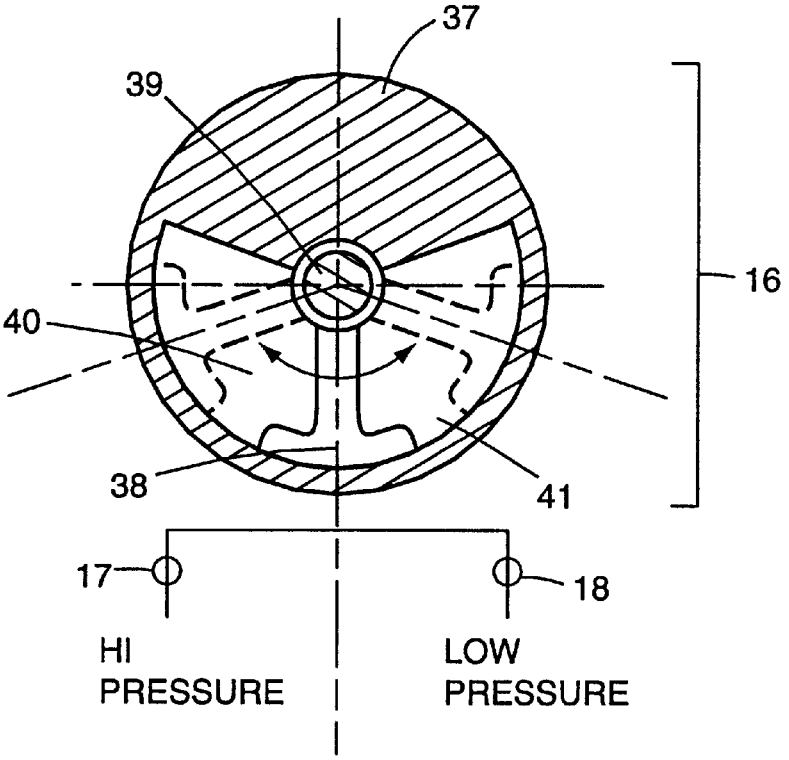
FIG. 7 is a diagrammatic front view of a sketch of a simple double acting torsional gas spring. The shaft of the torsional gas spring would be connected rigidly to the crankshaft on its axis of rotation. The gas spring is an alternative means for storing elastic energy.

FIG. 7 shows a torsional double acting gas spring 16 that may be advantageously connected to the crankshaft 39 of the pump for storing elastic energy. The torsional double acting gas spring is a possible torsional spring design alternative to the torsional spring shown in FIG. 4 (3). The gas spring vane 38 alternately compresses and expands each space 40 and 41 as the vane moves sealingly in housing 37 in a clockwise and anti-clockwise fashion. Each space 40 and 41 form counteracting gas springs which act in parallel and in a manner that reduces the well-known non-linear behavior of gas springs. By reducing the non-linear behavior, the double acting gas spring will respond with a restoring force versus displacement with a higher degree of linearity than a single gas spring. In order to minimize input power, the resonance of the gas spring may be advantageously maintained or controlled by adjusting the mean pressure within the gas spring. This may be accomplished by connecting the gas spring 16 to controlled valves 17 and 18 with are themselves connected to the high and low pressures of the thermodynamic cycle. The advantages of the gas spring may be in size and mass and the possibility of controlled resonance which reduces overall power input to the pump.

Figure 8:
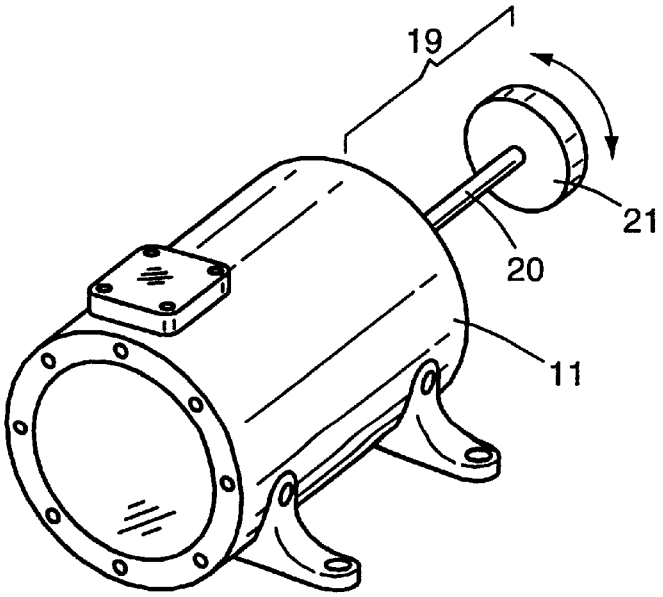
FIG. 8 is a view in perspective of a torsional vibration absorber essentially attached to the crankcase of the pump. This device avoids transmission of vibration.

FIG. 8 shows a simple torsional vibration absorber 19 attached to the crankcase 11. The torsional vibration absorber consists of a torsional spring 20 for storing elastic energy and a rotating mass 21 attached to the torsional spring 20. The mass and torsion spring just described are chosen so that their natural rotational oscillatory frequency is that of the driven frequency of the compressor. Since operation of the compressor herein described is at a constant frequency, it is a simple and well understood process that the casing torsional vibration will be balanced by the use of the torsional vibration absorber.

Figure 9:
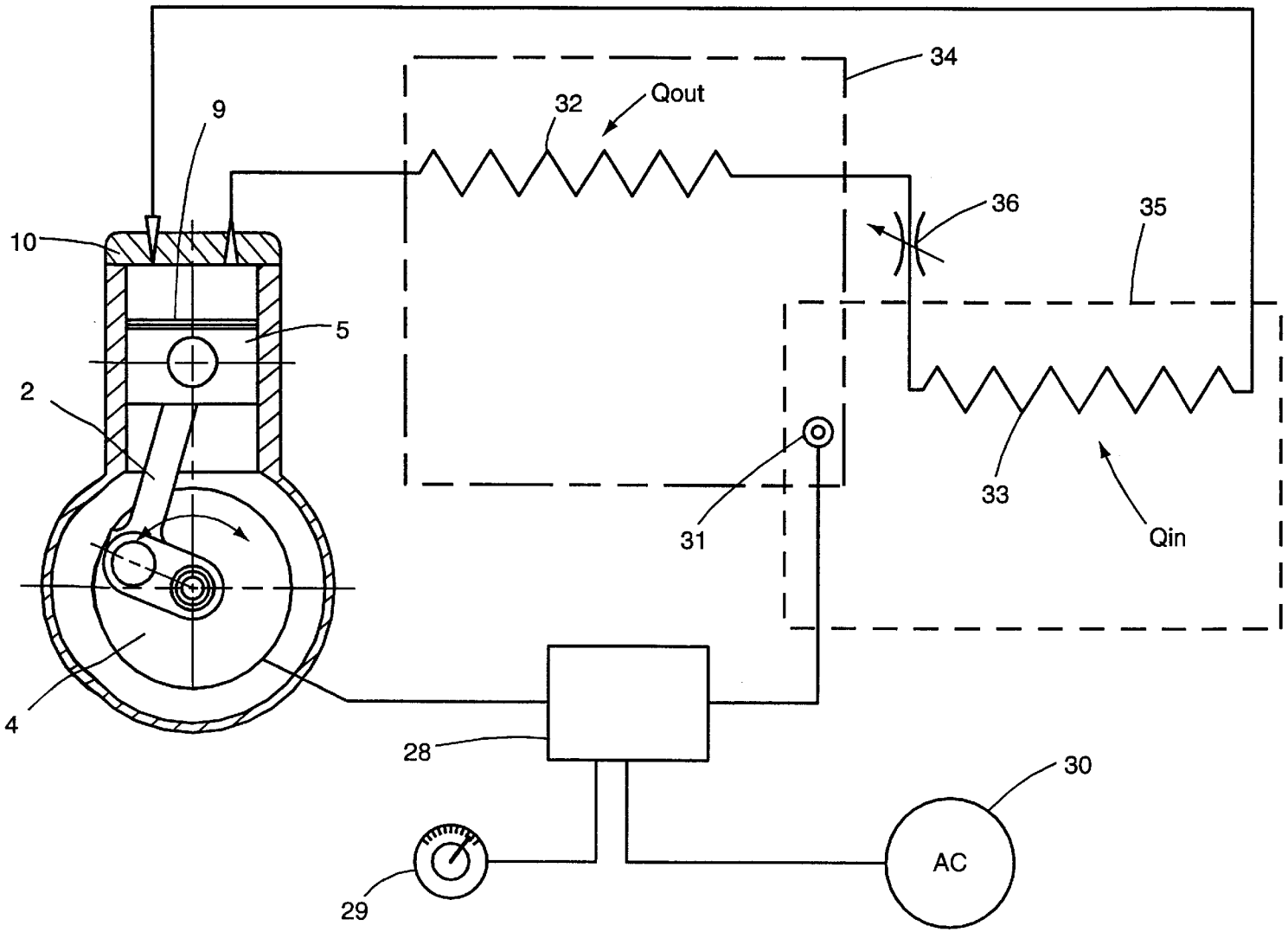
FIG. 9 is a schematic diagram of the pump used as a modulating compressor in a typical Rankine system. Both refrigerating and heat pumping applications are indicated.

FIG. 9 shows a possible control system for the case of the pump being used as a modulating compressor in a Rankine cycle refrigeration/heat pumping system. The controller 28 alters the RMS drive voltage in response to the closeness of approach between the set point temperature and the measured temperature. The controller is a negative feedback control system which varies the RMS drive voltage applied to the motor 4 in response to the difference between the temperature sensed by temperature transducer 31 and the set point temperature at control input 29, and operates according to conventional negative feedback control principles. The set point temperature is set by the user at control input 29 and the measured temperature is determined by temperature transducer 31. There are a number of options for the controller 28, the preferred embodiment being a Triac based device as described by R. Redlich Such control systems are illustrated in Redlich U.S. Pat. Nos. 5,156,005; 5,450,521; and 5,592,073, which are incorporated herein by reference. Power input, in this case, is an alternating voltage source 30. The heat rejector 32 is the heat exchanger where heat from the cycle is rejected (Qout) and the heat acceptor 33 is the heat exchanger where heat from the environment is absorbed (Qin). Depending on the desired output of the device, that is, either heating or cooling, boundaries 34 and 35 represent use either as a heat pump or refrigerator respectively. Variable expansion valve 36 is vital to the cycle since it together with the compressor sets the operating temperatures of the cycle. There are two well established techniques for variable expansion valve operation. They are referred to as thermostatic expansion valves or automatic expansion valves (Ref ASHRAE Handbook HVAC Systems and Equipment, 1996, page 43.2). The Thermostatic expansion valve maintains a constant super heat at a point near the outlet of the evaporator and the Automatic expansion valve maintains a constant suction pressure. Since the compressor will be changing the mass flow rate of the refrigerant it is necessary, in order to take full advantage of the modulatability of the compressor, to use a variable expansion valve. This will provide the appropriate pressure drop separating the cold and warm sides irrespective of refrigerant flow rate. In so doing, the compressor may be adjusted to operate at exactly the same cooling or heating capacity as the load and therefore minimize the required input of electrical energy at 30.

While certain preferred embodiments of the present invention have been disclosed in detail, it is to be understood that various modifications may be adopted without departing from the spirit of the invention or scope of the following claims.

I claim:

1. An improved fluid pump comprising:

(a) an expansible chamber pump having a piston reciprocatingly and sealingly slidable in a cylinder formed in a housing, a fluid inlet and a fluid outlet in fluid communication with the cylinder, a drive shaft mounted for rotary motion, and a drive linkage drivingly linking the piston to the shaft for converting rotary motion of the shaft to reciprocating motion of the piston;

(b) a motor, including a rotor drivingly linked to the shaft and adapted for driving the crank in a steady state rotary, angularly oscillating motion at an operating frequency of the pump; and (c) a spring linked from the housing to the motor and shaft for storing energy during rotary oscillation of the shaft, the spring having a spring constant resonating a composite combination of all movable masses, which are linked together, substantially at said operating frequency.

2. A pump in accordance with claim 1 wherein the spring is relaxed at an intermediate angular position of the shaft.

3. A pump in accordance with claim 2 wherein the relaxed position of the spring is at top dead center of the piston's path of reciprocation.

4. A pump in accordance with claim 3 wherein the motor is adapted to drive the shaft through an angle not exceeding substantially 180 degrees.

5. A pump in accordance with claims 1 or 2 or 3 or 4 wherein the shaft is a crankshaft and the drive linkage includes a connecting rod linking the crankshaft to the piston.

6. A pump in accordance with claims 1 or 2 or 3 or 4 wherein the drive linkage is a scotch yoke.

7. A pump in accordance with claims 1 or 2 or 3 or 4 and further comprising a plurality of cylinders in the housing, each having a sealingly slidable piston and each piston drivingly linked to the shaft.

8. A pump in accordance with claims 1 or 2 or 3 or 4 and further comprising a torsional vibration absorber linked to the shaft.

9. A pump in accordance with claims 1 or 2 or 3 or 4 wherein the spring is a torsional spring.

10. A pump in accordance with claim 9 wherein the torsional spring is a gas spring.

11. A pump in accordance with claims 1 or 2 or 3 or 4 wherein the motor is an electric motor.

12. A pump in accordance with claim 11 and further comprising a negative feedback control circuit connected to a source of AC electrical power and having a controlled voltage output connected to said electric motor, the control system having a measured parameter input and a set point input for varying the output voltage in response to the difference between the control input and the measured input.

13. A pump in accordance with claim 12 wherein the expansible chamber pump is connected in a Rankine cycle heat pumping apparatus and the measured parameter input is a sensed temperature.

14. A method for operating a fluid pump having a piston reciprocatingly and sealingly slidable in a cylinder, a fluid inlet and a fluid outlet in fluid communication with the cylinder, a drive shaft mounted for rotary motion and having a mass, a drive linkage drivingly linking the piston to the shaft for converting rotary motion of the shaft to reciprocating motion of the piston, and a motor drivingly linked to the drive shaft, the method comprising:

actuating the motor in angular oscillations; and, storing energy in a spring linked to the motor and shaft during rotary oscillation of the shaft.

15. A method in accordance with claim 14 wherein the motor is angularly oscillated through an angle not exceeding substantially 180 degrees and centered at a top dead center position of the piston.

16. A method in accordance with claim 14 or claim 15 wherein the angle of oscillation is varied to vary the displacement of the pump.

17. A method in accordance with claim 16 wherein the motor is an electric motor and the voltage applied to the motor is varied to vary the angle of oscillation.

* * * * *